US011050147B2

(12) United States Patent
Zaric

(10) Patent No.: US 11,050,147 B2
(45) Date of Patent: Jun. 29, 2021

(54) CERAMIC SMT CHIP ANTENNAS FOR UWB OPERATION, METHODS OF OPERATION AND KITS THEREFOR

(71) Applicant: TAOGLAS GROUP HOLDINGS LIMITED, Enniscorthy (IE)

(72) Inventor: Andela Zaric, Munich (DE)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 69 days.

(21) Appl. No.: 16/051,611

(22) Filed: Aug. 1, 2018

(65) Prior Publication Data

US 2019/0044231 A1 Feb. 7, 2019

Related U.S. Application Data

(60) Provisional application No. 62/540,155, filed on Aug. 2, 2017.

(51) Int. Cl.

| | |
|---|---|
| ***H01Q 5/25*** | (2015.01) |
| ***H01Q 1/48*** | (2006.01) |
| ***H01P 3/00*** | (2006.01) |
| ***H01Q 5/50*** | (2015.01) |
| ***H01P 5/02*** | (2006.01) |
| ***H01Q 9/40*** | (2006.01) |
| ***H01Q 1/38*** | (2006.01) |

(52) U.S. Cl.

CPC ..... *H01Q 5/25* (2015.01); *H01P 3/003* (2013.01); *H01P 5/022* (2013.01); *H01Q 1/48* (2013.01); *H01Q 5/50* (2015.01); *H01Q 9/40* (2013.01); *H01Q 1/38* (2013.01)

(58) Field of Classification Search

CPC .. H01Q 9/40; H01Q 1/38; H01Q 1/48; H01Q 5/25; H01Q 5/50

See application file for complete search history.

(56) References Cited

U.S. PATENT DOCUMENTS

| | | | |
|---|---|---|---|
| 7,327,315 | B2 | 2/2008 | Starkie et al. |
| 8,531,337 | B2 | 9/2013 | Castany et al. |
| 8,717,240 | B2 | 5/2014 | Flores-Cuadras et al. |
| 9,520,649 | B2 | 12/2016 | Rochemont |

(Continued)

FOREIGN PATENT DOCUMENTS

| | | | |
|---|---|---|---|
| KR | 20090065649 | A | 6/2009 |
| WO | 2005002422 | A2 | 1/2005 |

OTHER PUBLICATIONS

Bonnet, et al, Ultra Wide Band Miniature Antenna, IEEE International Conference on Ultra-Wideband: pp. 678-682, published in 2007.

(Continued)

*Primary Examiner* — Robert Karacsony
(74) *Attorney, Agent, or Firm* — Garson & Gutierrez, PC

(57) ABSTRACT

Disclosed are devices, systems and methods regarding ceramic-substrate ultra-wideband (UWB) antennas that utilize surface-mount technology (SMT) for installation, integration and connection to external devices, electronics and systems. Numerous configurations are disclosed for elements comprising each antenna. This ensures that the disclosed antennas may be configured in design to address varying performance requirements as well as to optimize performance across portions of the UWB spectrum.

29 Claims, 6 Drawing Sheets

(56) References Cited

U.S. PATENT DOCUMENTS

| | | | | |
|---|---|---|---|---|
| 9,748,663 | B2 | 8/2017 | Wong | |
| 2005/0030230 | A1* | 2/2005 | Otaka | H01Q 1/38 343/700 MS |
| 2005/0248487 | A1* | 11/2005 | Okado | H01Q 1/38 343/700 MS |
| 2008/0018538 | A1* | 1/2008 | Kushihi | H01Q 1/243 343/700 MS |
| 2009/0243940 | A1* | 10/2009 | Humphrey | H01Q 1/2283 343/700 MS |
| 2010/0048266 | A1* | 2/2010 | Maruyama | H01Q 1/243 455/575.7 |

OTHER PUBLICATIONS

Chen, et al., Planar Antennas, IEEE Microwave Magazine, pp. 63-73 (Dec. 2006).

Chung, et al., Wideband Microstrip-Fed Monopole Antenna Having Frequency Band-Notch Function, IEEE Microwave and Wireless Components Letters 15(11):766-768, Nov. 2005.

Digikey, Miniature RF Ceramic Chip Antenna (Oct. 4, 2016).

Johanson Technology, High Frequency Ceramic Solutions (Mar. 16, 2018).

Lee, et al., Design of Compact Chip Antenna for UWB Applications, IEEE International Conference on Ultra-Wideband: 155-158, published in 2009.

Liang, et al., Study of a Printed Circular Disc Monopole Antenna for UWB Systems, IEEE Transactions on Antennas and Propagation 53(11):3500-2504, Nov. 2005.

Liu, et al, A Planar Chip Antenna for UWB Applications in Lower Band, 2007 IEEE Antennas and Propagation Society International Symposium: 5147-5150, published in 2007.

Park, et al, Compact UWB Chip Antenna Design, IEEE Proceedings of Asia-Pacific Microwave Conference 2010: 730-733, published in 2010.

Taoglas, UWC.20 3-5 GZ and 6-9 GHz Ultra-Wide Band (UWB) SMD Chip Antenna (May 14, 2018).

* cited by examiner

CERAMIC SMT CHIP ANTENNAS FOR UWB OPERATION, METHODS OF OPERATION AND KITS THEREFOR

CROSS-REFERENCE

This application claims the benefit of U.S. Provisional Patent Application No. 62/540,155, filed Aug. 2, 2017, entitled CERAMIC SMT CHIP ANTENNAS FOR UWB OPERATION AND METHODS, which application is incorporated herein by reference in its entirety.

BACKGROUND

Field

The present disclosure relates in general to an antenna, and, in particular, to a ceramic-substrate, ultra-wideband (UWB) antenna.

The FCC has defined UWB as an antenna transmission for which emitted signal bandwidth exceeds the lesser of 500 MHz or 20% of the arithmetic center frequency and has authorized the unlicensed use of UWB in the frequency range from 3.1 to 10.6 GHz. In EU applications, a sub-band from 6 GHz to 8.5 GHz, is authorized. Unlike current and historical narrow band communications systems such as Cellular, Wi-Fi and GNSS, UWB communications systems can address emerging market needs and offer a host of possibilities for new products and systems.

Existing localization technologies such as Assisted GPS for Indoors, Wi-Fi and Cellular fingerprinting are at best able to offer meter precision, while UWB enables centimeter level localization precision for indoor and outdoor localization as well as very high transmission speed. This technology potential comes from the ultra-wide frequency bandwidth which means that the radiated pulses can be of duration less than 1 millisecond.

Potential applications for UWB technologies include smart home and entertainment systems that can take advantage of high data rates for streaming high quality audio and video content in real time, localization applications in healthcare and safety for seniors and infants, or even precise non-invasive and non-ionizing imaging for cancer detection. Other applications may include precise asset localization and identification for security, such as wireless keyless cars and premise entry systems. These and other applications dictate new approaches to communications systems design, opening possibilities for novel, advanced antenna design and implementation.

What is needed is a new generation of UWB antennas with designs that take advantage of, for example, surface-mount technology (SMT) for ready integration into current-generation and next-generation electronic devices. Additional benefits may be realized if such antennas have small form factors that facilitate installation and address diminishing package requirements.

SUMMARY

Disclosed are devices, systems and methods for UWB antennas that utilize surface-mount technology (SMT) for installation, integration and connection to external devices, electronics and systems. Disclosed antennas can use a dielectric ceramic-substrate. Numerous configurations and geometries are disclosed for radiators, feed lines, and connection pad elements which can be selected for each antenna. Selection from a plurality of geometries ensures that the resulting antenna design is configurable to address specific performance, application and packaging requirements as well as to optimize performance of the antenna across portions of the UWB spectrum.

The disclosed UWB antennas comprise a small form factor dielectric ceramic element with a radiator, feed areas, connection pads and metallic elements and are mountable on a substrate with a ground plate, a feed line, a coaxial RF connector and metallic elements for connection to external devices, electronics, and/or systems via SMT solder joints.

An aspect of the disclosure is directed to ultra-wideband antennas. Suitable ultra-wideband antennas comprise: a dielectric substrate having a substrate length, a substrate width and a substrate thickness, a first surface, a second surface, a third surface, a fourth surface, a fifth surface, and a sixth surface; a radiator positioned on at least a portion of the first surface of the dielectric substrate; a feed positioned on the second surface of the dielectric substrate; and a feed positioned on a third surface of the dielectric substrate perpendicular to the second surface of the dielectric substrate. In at least some configurations, the dielectric substrate can be a ceramic dielectric substrate. Additionally, the ultra-wideband antennas are configurable to operate within a range of frequencies from 3.1 GHz to 10 GHz. The first surface of the dielectric substrate can have a two-dimensional shape selected from, for example, square, rectangular, parallelogram, oval, and round. The first surface of the dielectric substrate can be at least one of planar and substantially planar. Additionally, the feed can be centered on the third surface of the dielectric substrate and occupies an entire substrate thickness and less than one-third of the substrate width or substrate length. The feed can also have a shape selected from, for example, circular, semi-circular, triangular, trapezoidal, square and rectangular. The radiator can have a shape selected from, for example, square, rectangular, semi-circular, circular, trapezoidal, and triangular. In some configurations the radiator has an irregular shape, such as a shape formed from a combination of two or more of square, rectangular, semi-circular, trapezoidal, and triangular. The feed area can be centered on the bottom surface of the dielectric substrate along a length and adjacent to an edge shared with one of the third surface, the fourth surface, the fifth surface, and the sixth surface. In some configurations, the antenna is positioned on a substrate in electrical communication with a feed line. The feed line can be in electrical communication with a connector. A first connection pad and a second connection pad positioned on the second surface of the dielectric substrate can be provided wherein the first connection pad is positioned adjacent a first side of the feed and the second connection pad is positioned adjacent a second side of the feed opposite the first connection pad. Additionally, a third connection pad positioned on the second surface of the dielectric substrate can also be provided.

Another aspect of the disclosure is directed to ultra-wideband antenna systems. The ultra-wideband antenna systems can comprise: an ultra-wideband antenna comprising a dielectric substrate having a substrate length, a substrate width and a substrate thickness, a first surface, a second surface, a third surface, a fourth surface, a fifth surface, and a sixth surface, a radiator positioned on at least a portion of the first surface of the dielectric substrate, a feed positioned on the second surface of the dielectric substrate, and a feed positioned on a third surface of the dielectric substrate perpendicular to the second surface of the dielectric substrate; and a ground plane having a feed line in electrical communication with the ultra-wideband antenna.

Additionally, one or more ground plane fingers can be provided. In some configurations a coaxial RF connector is also provided. The feed line can also be configurable to terminate on the ground plane within a perimeter of the feed of the antenna. Two metallic elements positioned either side of the feed line on the ground plane separated by gaps can be provided which form a coplanar waveguide. The antennas are configurable to transmit a large amount of digital data over a wide spectrum of frequency bands spanning more than 500 MHz at a low power for short distances. Additionally, the antennas can cover UWB band 1 through UWB band 10 simultaneously. The ultra-wideband antenna is further configurable to include a first connection pad and a second connection pad positioned on the second surface of the dielectric substrate wherein the first connection pad is positioned adjacent a first side of the feed and the second connection pad is positioned adjacent a second side of the feed opposite the first connection pad. A third connection pad positioned on the second surface of the dielectric substrate can also be provided.

Still another aspect of the disclosure is directed to methods of using ultra-wideband antennas comprising the steps of: providing an ultra-wideband antenna comprising a dielectric substrate having a substrate length, a substrate width and a substrate thickness, a first surface, a second surface, a third surface, a fourth surface, a fifth surface, and a sixth surface, a radiator positioned on at least a portion of the first surface of the dielectric substrate, a feed positioned on the second surface of the dielectric substrate, and a feed positioned on a third surface of the dielectric substrate perpendicular to the second surface of the dielectric substrate; operating the ultra-wideband antenna at radio-frequency communications from 3.1 GHz to 10 GHz. The methods can also include one or more of operating the ultra-wideband antenna at a peak gain of 4 dBi, operating the ultra-wideband antenna at an efficiency of more than 60% across UWB band 1 through UWB band 10, and operating the ultra-wideband antenna at an efficiency of more than 60% across UWB band 1 through UWB band 10 occurs simultaneously. Additionally, the ultra-wide antennas of the method can further comprise a first connection pad and a second connection pad positioned on the second surface of the dielectric substrate wherein the first connection pad is positioned adjacent a first side of the feed and the second connection pad is positioned adjacent a second side of the feed opposite the first connection pad.

Yet another aspect of the disclosure is directed to ultra-wideband antenna kits. Suitable kits comprise: one or more ultra-wideband antennas comprising a dielectric substrate having a substrate length, a substrate width and a substrate thickness, a first surface, a second surface, a third surface, a fourth surface, a fifth surface, and a sixth surface, a radiator positioned on at least a portion of the first surface of the dielectric substrate, a feed positioned on the second surface of the dielectric substrate, and a feed positioned on a third surface of the dielectric substrate perpendicular to the second surface of the dielectric substrate; and one or more of each of a ground plane, a PCB, a connector, and a cable. The ultra-wide antennas of the kits can further comprise a first connection pad and a second connection pad positioned on the second surface of the dielectric substrate wherein the first connection pad is positioned adjacent a first side of the feed and the second connection pad is positioned adjacent a second side of the feed opposite the first connection pad. Additionally, the ultra-wide antennas of the kits can further comprise a third connection pad positioned on the second surface of the dielectric substrate.

INCORPORATION BY REFERENCE

All publications, patents, and patent applications mentioned in this specification are herein incorporated by reference to the same extent as if each individual publication, patent, or patent application was specifically and individually indicated to be incorporated by reference. See, for example:

BONNET, et al, Ultra Wide Band Miniature Antenna, IEEE International Conference on Ultra-Wideband: pp. 678-682, published in 2007;

CHEN, et al. Planar Antennas, IEEE Microwave Magazine, pp. 63-73 (December 2006);

CHUNG, et al. Wideband Microstrip-Fed Monopole Antenna Having Frequency Band-Notch Function, IEEE Microwave and Wireless Components Letters 15(11): 766-768, November 2005;

DIGIKEY, Miniature RF Ceramic Chip Antenna, Oct. 4, 2016;

LIANG, et al., Study of a Printed Circular Disc Monopole Antenna for UWB Systems, IEEE Transactions on Antennas and Propagation 53(11):3500-2504, November 2005;

LIU, et al, A Planar Chip Antenna for UWB Applications in Lower Band, 2007 IEEE Antennas and Propagation Society International Symposium: 5147-5150, published in 2007;

LEE, et al, Design of Compact Chip Antenna for UWB Applications, IEEE International Conference on Ultra-Wideband: 155-158, published in 2009;

PARK, et al, Compact UWB Chip Antenna Design, IEEE Proceedings of Asia-Pacific Microwave Conference 2010: 730-733, published in 2010;

KR 2009/0065649 A published Jun. 23, 2009, to Yeom for Solid ultra-wide band antenna;

U.S. Pat. No. 7,327,315 B2 issued Feb. 5, 2008, to Starkie et al. for Ultrawideband Antenna;

U.S. Pat. No. 8,531,337 B2 issued Sep. 10, 2013, to Soler et al. for Antenna Diversity System and Slot Antenna Component;

U.S. Pat. No. 8,717,240 B2, issued May 6, 2014, to Flores-Cuadras, et al., for Multi-Angle Ultrawideband Antenna with Surface Mount Technology;

U.S. Pat. No. 9,520,649 B2 issued Dec. 13, 2016, to De Rochemont for Ceramic Antenna Module and Methods of Manufacture Thereof;

U.S. Pat. No. 9,748,663 B2 issued Aug. 29, 2017, to Wong for Metamaterial Substrate for Circuit Design; and WO 2005/002422 A2 published Oct. 25, 2005 to Arand et al. for Method and System for Detection of Heart Sounds.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Disclosed are a series of antennas and antenna systems which are suitable for UWB radio-frequency communications from 3.1 GHz to 10 GHz. The antennas and antenna systems achieve a small form factor and are configurable to utilize surface-mount technology (SMT) to facilitate integration and connection to external devices and electronics. Additionally, the antennas and antenna systems are configurable to utilize a dielectric ceramic-substrate.

Figure 1A:
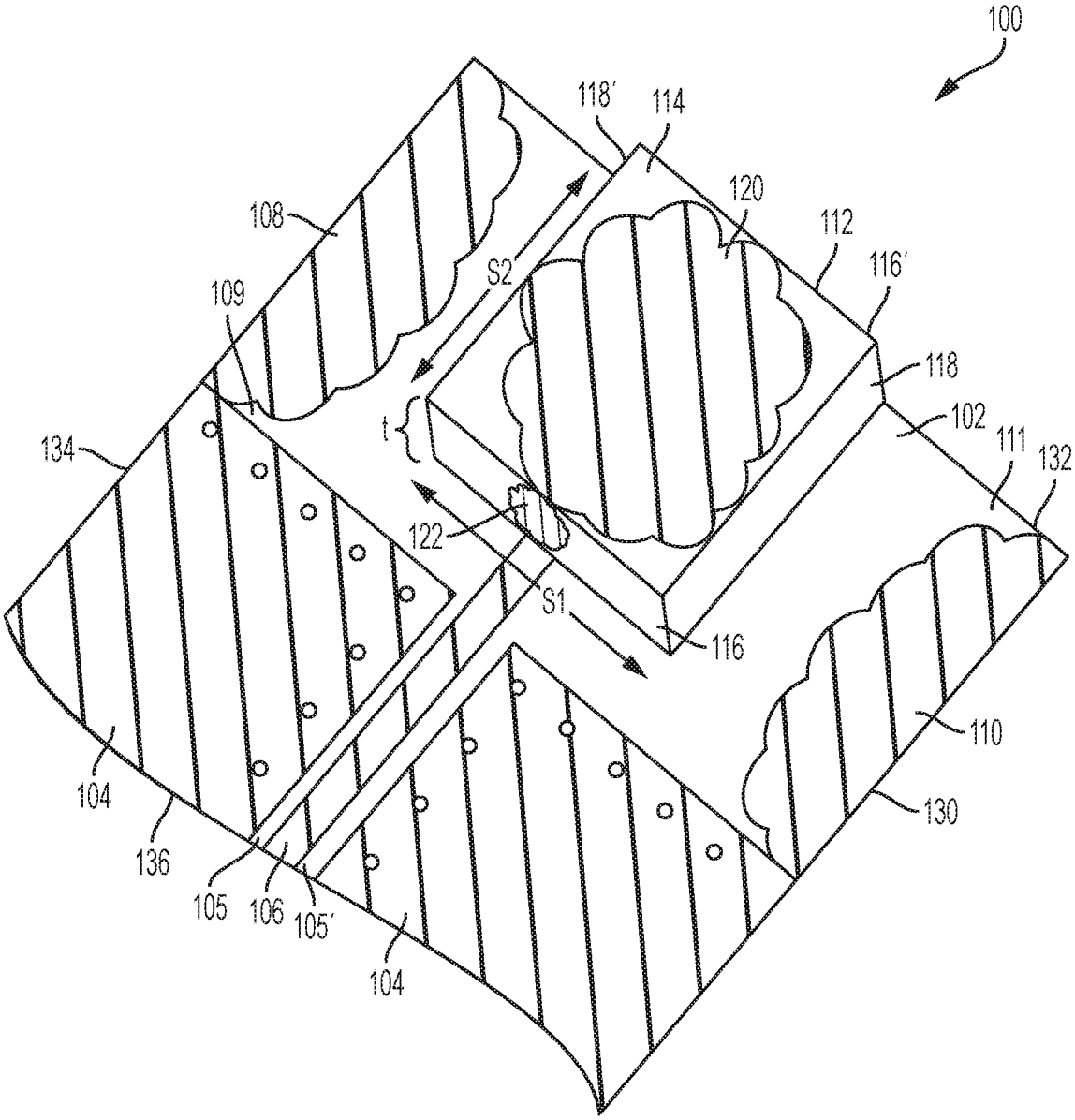
FIG. 1A is an isometric illustration of an ultra-wideband antenna assembly as viewed from above.

Turning to FIG. 1A, an isometric illustration of a generic embodiment from an upper surface of the disclosed antenna system. In the generic embodiment, the antenna 100 is mounted on a ground plane 102 having a first side 130, a second side 132, a third side 134, and a fourth side 136 via surface-mount technology and secured to the ground plane 102 via solder bonding. The fourth side 136 is shown with a curved edge in view of the fact that the length of the first side 130 and third side 134, for example, can have a variable length which is takes into consideration installation and performance requirements. The antenna 100 is depicted as a three-dimensional element having six faces with a width S1, a length S2 and a thickness t. The antenna 100 can have a dielectric-ceramic substrate.

The antenna 100 comprises a dielectric-ceramic substrate 112, and a number of areas within which lie metallic elements including: a generic radiator 120, a generic side feed area 122, a generic bottom feed area (not visible in FIG. 1A) and a generic bonding areas (not visible in FIG. 1A). As will be appreciated by those skilled in the art, the generic radiator 120 can employ a variety of geometries which may, in some configurations, cover the entire top surface 114 of the antenna 100.

The top surface 114 of the antenna can be rectangular-shaped or square-shaped and planar or substantially planar. The generic radiator 120 can be positioned on or within the top surface 114 of the antenna 100. Visible in FIG. 1A, is first side surface 116 and second side surface 118. The third side 116' (not fully visible in FIG. 1A) lies opposite, and is of equal dimension to the first side surface 116. The fourth side 118' (also not fully visible in FIG. 1A) lies opposite, and is of equal dimension to the second side surface 118. As noted above, the antenna 100 has a width S1 and a length S2. When width S1 is equal to length S2, the top surface 114 has, for example, a square configuration. When width S1 is not equal to length S2, the top surface 114 has, for example, a rectangular configuration. In practice the thickness t can be much smaller than either the width S1 or the length S2, typically on the order of 1/20 to 1/4 that of the width S1 and/or the length S2. The width S1 can have a value of from about 4 mm to about 16 mm, more specifically about 12 mm. Similarly the length S2 can have a value of from about 4 mm to about 16 mm, more specifically about 12 mm. The thickness t of the antenna 100 can be from about 1 mm to about 3 mm, more preferably 2 mm. As will be appreciated by those of skill in the art, other shapes can be used without departing from the scope of the disclosure including, for example, oval, circular, and parallelogram.

Centered on the first side surface 116 of the antenna 100 and occupying the entire thickness t and approximately one-quarter to one-third of the width S1 is generic side feed area 122. In various embodiments of the disclosure, a metallic element lying within the perimeter of generic side feed area 122 completes the connection between a feed line 106 on the ground plane 102 and the generic radiator 120 on the top surface 114 of the antenna 100. The feed line 106 lies on ground plane 102 and extends from a part beneath the first side surface 116 of the antenna 100 in a perpendicular direction from the first side surface 116. The feed line 106 provides a connection from the antenna 100 to external electronics or devices. Lying on either side of feed line 106 on ground plane 102 and separated by first ground plane gap 105, and second ground plane gap 105' are metal elements which together form a coplanar waveguide 104.

Optionally, extending from the coplanar waveguide 104, and positioned on the ground plane 102 on either side of antenna 100 separated by a first ground plane finger gap 109 is an area forming a first generic ground plane finger 108 which is adjacent a third ground plane side 134. One or more ground plane fingers can be used without departing from the scope of the disclosure. An area forming a second generic ground plane finger 110 is positioned adjacent a first ground plane side 130 and separated by second ground plane finger gap 111 from the antenna 100. As viewed in FIG. 1A, the first generic ground plane finger 108 lies to the left of antenna 100, and second generic ground plane finger 110 lies to the right of antenna 100. As will be appreciated by those skilled in the art, the shapes of the metal structures which lie within the area comprising the first generic ground plane finger 108 and the area comprising the second generic ground plane finger 110 may vary to achieve desired performance characteristics of the antenna 100.

Figure 1B:
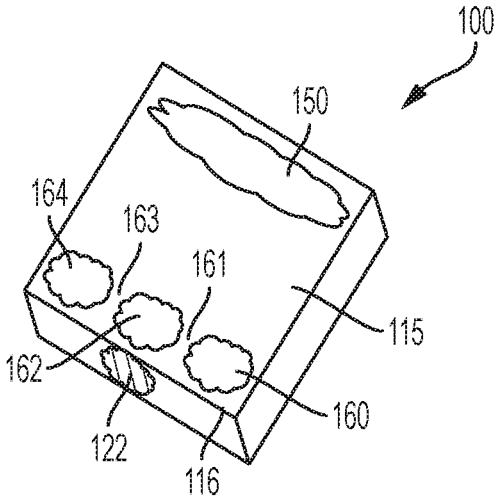
FIG. 1B is an isometric illustration of the chip substrate shown in FIG. 1A from a bottom surface.
Figure 1C:
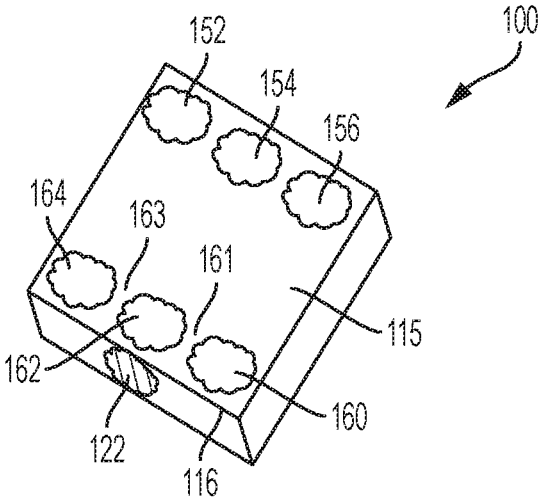
FIG. 1C is an isometric illustration of an alternate chip substrate shown in FIG. 1A from a bottom surface.

The antenna 100 viewed from a bottom surface 115 can have many different embodiments of the number and position of connection pads, two of the generic configurations are illustrated in FIG. 1B and FIG. 1C. Opposite first side surface 116, on the bottom surface 115 of the antenna 100 lies a third connection pad area 150 depicted in FIG. 1B running along the entire length of the edge opposite the generic side feed area 122. Three connection pads separated by gaps can be positioned across a bottom feed area which includes a bottom feed 162 and a first connection pad 160 on the right side separated by a first connection pad gap 161 and second connection pad 164 on the left side of the bottom feed 162 and separated by second connection pad gap 163. As shown in FIG. 1C the third connection pad area 150 shown in FIG. 1B is replaced by a fourth connection pad 152, a fifth connection pad 154, and a sixth connection pad 156. Changing the connection pad area impacts the mechanical stability of the antenna once soldered to the PCB. For example, if three or more connection pads are used, the antenna is more strongly soldered to the PCB and is mechanically more resistant to vibration and shock.

As will be appreciated by those skilled in the art, the various components illustrated in FIGS. 1A-C (e.g., radiator, plane fingers, side feed, connection pads, and waveguides) can be formed integrally with one or more adjacent components so that the components function as a single component without departing from the scope of the disclosure.

Figure 2:
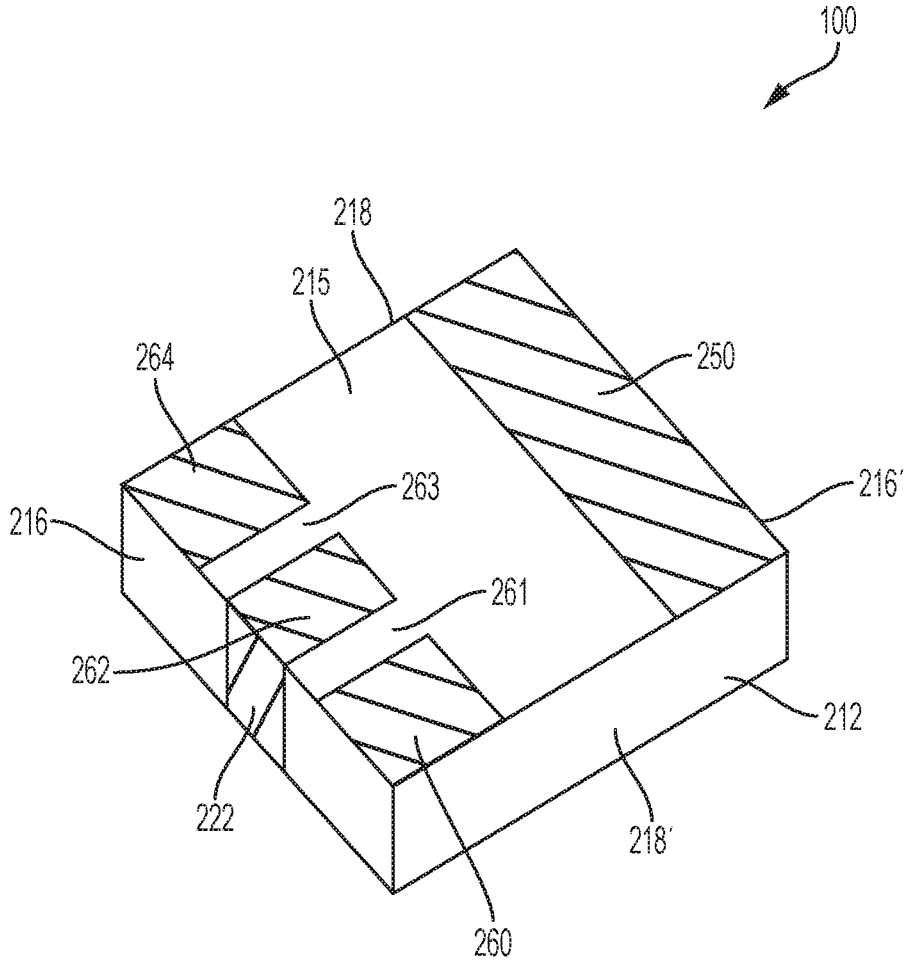
FIG. 2 is an isometric illustration of an ultra-wideband antenna as viewed from below.

Turning now to FIG. 2, an isometric illustration of antenna 100 such as that shown in FIG. 1A with a dielectric substrate 212, as viewed from a bottom surface 215. As illustrated, the bottom surface 215 of antenna 100, is planar or substantially planar and is of the same dimension as the top surface 114 shown in FIG. 1A. Centered on bottom surface 215, adjacent to the edge shared with first side surface 216, is bottom feed area 262. Visible on the first side surface 216, is side feed area 222. In the various different embodiments of the disclosure, a metallic element lies within the perimeter circumscribed by the bottom feed area 262. Thus, an integral connection is formed from the feed line 106 in FIG. 1A, which terminates on the ground plane 102 of FIG. 1A opposite and within the perimeter of the bottom feed area 262 of FIG. 2, through contiguous metallic elements residing within generic bottom feed area and side feed area 222 and proceeding to that metallic element comprising the radiator which lies within the generic radiator 120 shown in FIG. 1A.

In the corner of the bottom surface 215, sharing an edge with the first side surface 216 and the fourth side surface 218 of antenna 100 in FIG. 2, and separated from bottom feed area 262 by a second connection pad gap 263 is the second connection pad 264. Continuing on the bottom surface 215, opposite the second connection pad 264, also sharing an edge with the first side surface 216 and second side surface 218' of the antenna 100, and separated from bottom feed area 262 by a first connection pad gap 261 is the first connection pad 260. The first connection pad 260 and the second connection pad 264 are roughly square in form with a side length approximately one-fourth to one-fifth that of dimension S1 of FIG. 1A.

Also on the bottom surface of antenna 100 is the third connection pad 250. The third connection pad 250 lies along the opposite edge of bottom surface 215 shared by the bottom feed area 262, first connection pad 260 and second connection pad 264. The third connection pad 250 extends along the entire length of antenna 100 in at least one direction along the third side surface 216', e.g. from a first edge to an opposite edge. Thus, the third connection pad 250 has a long side length equal to width S1 shown in FIG. 1A. The short width can be approximately one-fourth to one-fifth that of length S2 shown in FIG. 1A. In the various different embodiments of the disclosure, metallic elements lie within the perimeter circumscribed by the first connection pad 260, second connection pad 264, and third connection pad 250. Such metallic elements, which may take various shapes, facilitate connection to external devices, electronics, and/or systems via SMT solder joints.

Numerous radiator geometries are possible and may be employed depending upon the desired performance characteristics of the antenna 100 disclosed herein. Turning to FIGS. 3A-J illustrations of several different possible metal radiator embodiments according to the disclosure is provided. Other shapes can be used without departing from the scope of the disclosure. Depicted are various views of geometries for the generic radiator 120 shown from the top surface 114 in FIG. 1A with the shaded area on each of the FIGS. 3A-3J representing a potential radiator configuration. Each of the radiators in FIGS. 3A-J are illustrated on a square substrate having a first side 304, a second side 306, a third side 310 and a fourth side 310 which provides relative context for the potential geometries. The first side 304 can correspond to the edge shared between the top surface 114 and first side surface 116 of the antenna 100 shown in FIG. 1A.

As will be appreciated by those skilled in the art, although the surface of FIGS. 3A-J are illustrated as square (i.e., positioned on a square substrate), where the width S1 is equal to the length S2, other configurations of the substrate can be used including configurations where the width S1 is not equal to the length S2, without departing from the scope of the disclosure as discussed above. Both the shape of the substrate and the shape of the radiator can be independently varied.

Figure 3A:
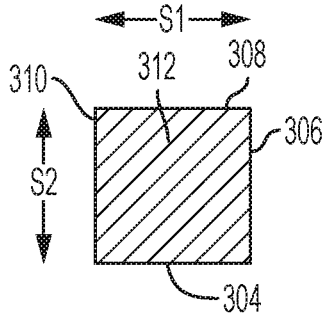
FIGS. 3A-J are illustrations of different radiator configurations according to the disclosure.

The first radiator configuration depicted in FIG. 3A is a square radiator 312 that covers the entire top surface 114 of a square substrate, such as the substrate that shown in FIG. 1A when the antenna has a dimension where S1=S2. If the width S1 did not equal the width S2, then the configuration illustrated in FIG. 3A, would illustrate, for example, a square radiator on a rectangular antenna substrate. Similarly, if the ceramic substrate is rectangular, the radiator could be rectangular and cover the entire top surface.

Figure 3B:
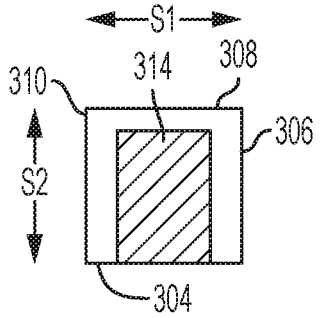

The second radiator configuration illustrated in FIG. 3B is a rectangular radiator 314 positioned on the square ceramic-substrate which does not cover the entire top surface. One side of the second radiator configuration lies along the first side 304. The length of the side of the rectangle which lies along first side 304 and that of its opposite side is less than dimension S1. The length of the other two sides of the rectangle comprising second radiator configuration can be the same as or less than dimension S2 (as illustrated). In the embodiment depicted, the resulting rectangle of second radiator configuration is centered between second side 306 and fourth side 310 of top surface 114 shown in FIG. 1A. Alternatively, second radiator configuration can be positioned off-center between second side 306 and fourth side 310 of the top surface 114 shown in FIG. 1A. A rectangular radiator could also be positioned to fully cover a rectangular surface of a rectangular substrate.

Figure 3C:
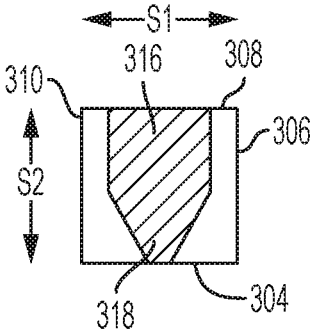

The third radiator configuration illustrated in FIG. 3C is shaped like a square-trapezoid radiator which is a combination of a square 316 with an isosceles trapezoid 318. The isosceles trapezoid 318 is shown positioned between second side 306 and fourth side 310 with its minor base coincident with the first side 304. The major base of the isosceles trapezoid has a length less than dimension S2. Adjacent to the major base of the isosceles trapezoid 318 is a square 316.

Figure 3D:
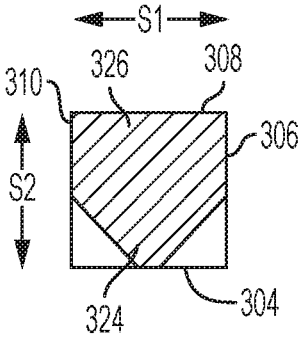

Similar to the third radiator configuration in FIG. 3C, is the fourth radiator configuration shown in FIG. 3D. The fourth radiator configuration is a triangular-trapezoid which comprises a second isosceles trapezoid 324 and a rectangle 326. As with the third radiator configuration, the minor base of the second isosceles trapezoid 324 is coincident with first side 304 of top surface 114 shown in FIG. 1A. The major base of second isosceles trapezoid 324 has a length equal to width S1. The rectangle 326 extends from the major base of the second isosceles trapezoid 324 to the third side 308 of the top surface 114 shown in FIG. 1A.

Figure 3E:
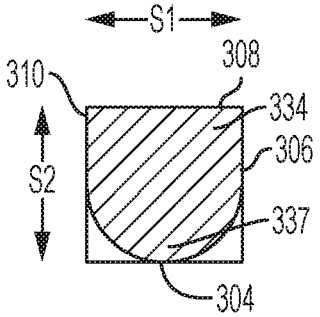

The fifth radiator configuration in FIG. 3E is a semicircular-rectangular radiator. The fifth radiator configuration has a semicircle 332 positioned such that it is tangent to the first side 304, second side 306, and fourth side 310 of the top surface 114 shown in FIG. 1A. The third rectangle 334 is continuous with the semicircular portion 337 and covers the remainder of the top surface 114 shown in FIG. 1A; the sides of the third rectangle 334 are coincident with the second side 306, third side 308, and fourth side 310. The width of the semi-circle portion 337 is equal to the length of one side of the third rectangle 334. A configuration where the width of the third rectangle 334 and diameter of the semi-circle portion 337 is less than the width S1, can also be employed without departing from the scope of the disclosure.

Figure 3F:
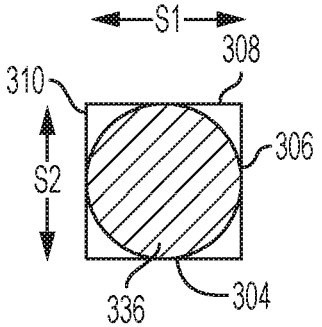

The sixth radiator configuration depicted in FIG. 3F is a circular radiator 336. As illustrated the circular radiator 336 can be sized and positioned such that it is tangent to the first side 304, second side 306, third side 308, and fourth side 310 of the top surface 114 shown in FIG. 1A of the antenna 100 shown in FIG. 1A.

Figure 3G:
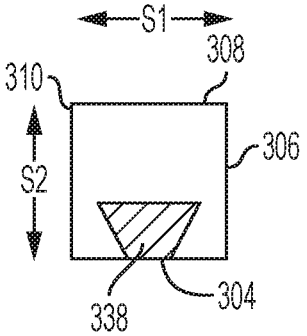
Figure 3H:
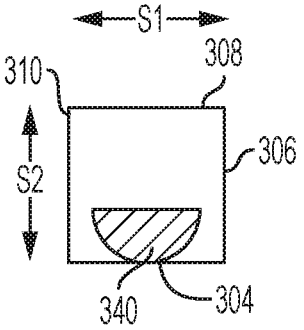

The seventh radiator configuration in FIG. 3G is a trapezoidal radiator 338. The trapezoidal radiator 338 has a minor base is coincident with first side 304; as illustrated, the length of its major base is less than width S1. The eighth radiator configuration shown in FIG. 311 is a semi-circular radiator 340. The eighth radiator configuration is tangent to first side 304. A chord line which defines a portion of its perimeter is parallel to first side 304 and the length of the chord line is less than width S1.

Figure 3I:
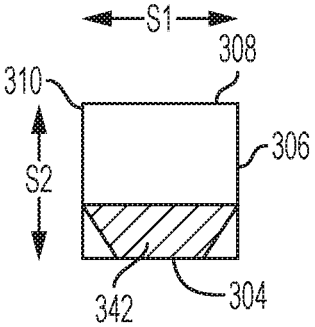

Similar in form to the seventh radiator configuration in FIG. 3G, the ninth radiator configuration shown in FIG. 3I is also a trapezoidal radiator 342. However, in this configuration, the minor base of the trapezoid forming the ninth radiator configuration is coincident with the first side 304 of top surface 114 shown in FIG. 1A. The major base of the quadrilateral is equal to width S1, spanning the entire length between the second side 306 and the fourth side 310 of the top surface 114 shown in FIG. 1A.

Figure 3J:
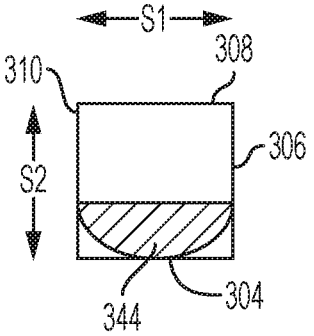

Comparable to the eighth radiator configuration of FIG. 311, the tenth radiator configuration illustrated in FIG. 3J is also a semi-circular radiator 344. The tenth radiator configuration is tangent to first side 304. The chord line which defines a portion of its perimeter is parallel to first side 304 and the length of the chord line is equal to dimension S1. Note that the points at which the radiator configuration touches the second side 306 and fourth side 310 are not necessarily tangent points. As will be appreciated by those skilled in the art, the various radiator configurations illustrated in FIGS. 3A-J may be modified in numerous aspects without departing from the scope and spirit of the disclosure.

Figure 4A:
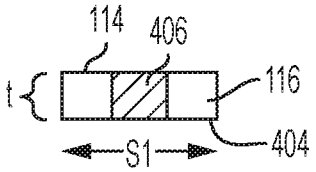
FIGS. 4A-C are illustration of three different side feed metallizations according to the disclosure.
Figure 4B:
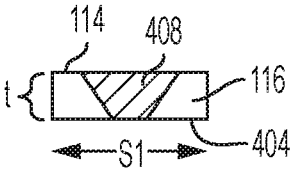
Figure 4C:
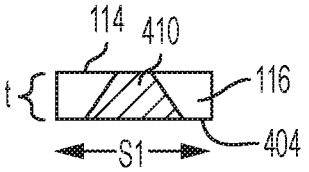

As with radiator geometries, numerous side feed geometries are possible. FIGS. 4A-C depict three possible configurations of the side-feed geometries from the first side surface 116 of the antenna 100 shown in FIG. 1A with the shaded area on each first side surface 116 representing a potential side feed configuration. Turning to FIG. 4A, the first side feed 406 is a square or rectangular side feed that is centered on first side surface 116 shown in FIG. 1A of the antenna 100. One side of first side feed 406 is of coincident with the top surface 114 shown in FIG. 1A while the opposite side is coincident with first bottom edge 404. The width of the two sides of the rectangle which are coincident with the top surface 114 shown in FIG. 1A and first bottom edge 404 shown in FIGS. 3A-J can greater than thickness t and less than the width S1. The second side feed configuration 408 shown in FIG. 4B is trapezoidal. The minor base of the second side feed configuration 408 is coincident with first bottom edge 404, while the major base is coincident with the top surface 114 shown in FIG. 1A. The width of both the minor base and the major base are less than width S1. The third side feed configuration 410 shown in FIG. 4C is also trapezoidal. The major base of the third side feed configuration 410 is coincident with first bottom edge 404, while the minor base is coincident with first side 304 shown in FIGS. 3A-J. The width of both the minor base and the major base are less than width S1. Other shapes of the third side feed configuration can be used without departing from the scope of the disclosure. For example, a circle or oval with a sliced off top and bottom edge to correspond to the flat upper and lower surface of the antenna can be employed.

Figure 5A:
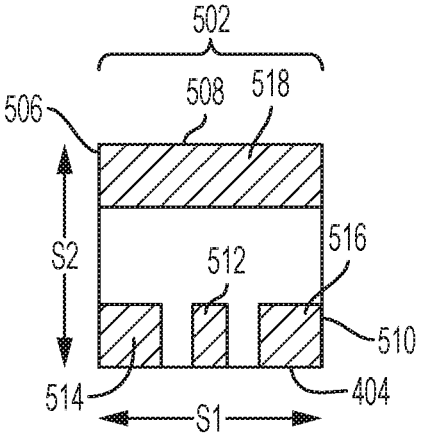
FIGS. 5A-B are illustrations of different bottom metallizations according to the disclosure.
Figure 5B:
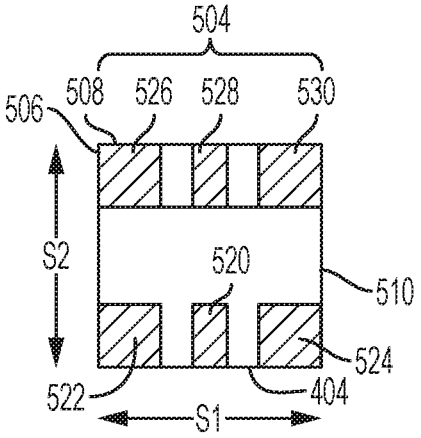

As with radiator and side feed geometries, numerous bottom feed and connection pad geometries are also possible. FIGS. 5A-B illustrate two such possible combinations of bottom feed and connection pad geometry. Depicted in are various views of bottom surface 115 shown in FIGS. 1B-C and FIG. 2 of the antenna 100 with the shaded areas on each one representing a bottom feed or connection pad configuration. Proceeding in clockwise fashion from the first bottom edge 404 shown in FIGS. 4A-C, the edges that complete the perimeter of bottom surface 115 shown in FIG. 2 are the second bottom edge 506, third bottom edge 508, and fourth bottom edge 510.

Turning to FIG. 5A, the first bottom surface configuration 502 comprises three metal connection pads and one metal feed line pad. Centered along first bottom edge 404, the first bottom feed configuration 512 is rectangular with one side coincident with first bottom edge 404. The width of the side of the rectangle of the first bottom feed configuration 512 is substantially less than width S1. The length of the sides of the rectangle of the first bottom feed configuration 512 parallel to second bottom edge 506 is substantially less than length S2.

In the corner formed by first bottom edge 404 and second bottom edge 506, resides a configuration of a first connection pad 514. The first connection pad 514 is rectangular with one side coincident with first bottom edge 404 and an adjacent side coincident with second bottom edge 506. The length of the side of the rectangle of the first connection pad 514 that is coincident with first bottom edge 404 and that of its opposite side is substantially less than width S1. The length of the side of the rectangle of the first connection pad 514 that is coincident with second bottom edge 506 and that of its opposite side is substantially less than length S2.

In the corner formed by first bottom edge 404 and fourth bottom edge 510, resides a configuration of a second connection pad 516. The second connection pad 516 is rectangular with one side coincident with first bottom edge 404 and an adjacent side coincident with fourth bottom edge 510. The width of the side of the rectangle of the second connection pad 516 that is coincident with first bottom edge 404 and that of its opposite side is substantially less than width S1. The length of the side of the rectangle of the second connection pad 516 that is coincident with fourth bottom edge 510 and that of its opposite side is substantially less than length S2. A configuration of a third connection pad 518 located on the first bottom surface configuration 502 is rectangular in shape, coincident with third bottom edge 508 and runs the entire length of third bottom edge 508. The length of the sides of the rectangle of the third connection pad 518 that are coincident with second bottom edge 506 and fourth bottom edge 510 is substantially less than length S2. The width along the third bottom edge 508 can be the same as the substrate, as illustrated.

The second bottom surface configuration 504 shown in FIG. 5B comprises five metal connection pads and one metal feed line pad. Centered along first bottom edge 404, a configuration of the second bottom feed 520 is illustrated as substantially identical to the first bottom feed configuration 512 in location and geometry. A configuration of the fourth connection pad 522 is rectangular with one side coincident with first bottom edge 404 and an adjacent side coincident with second bottom edge 506; is illustrated as substantially identical to the first connection pad 514 in geometry and location. A configuration of the fifth connection pad 524 is rectangular with one side coincident with first bottom edge 404 and an adjacent side coincident with fourth bottom edge 510 is illustrated as substantially identical to the second connection pad 516 in geometry and location.

In the corner formed by the second bottom edge 506 and third bottom edge 508, resides a configuration of a sixth connection pad 526. The sixth connection pad 526 is rectangular with one side coincident with second bottom edge 506 and an adjacent side coincident with third bottom edge 508. The length of the side of the rectangle of the sixth connection pad 526 that is coincident with second bottom edge 506 and that of its opposite side is substantially less than length S2. The length of the side of the rectangle of the sixth connection pad 526 that is coincident with third bottom edge 508 and that of its opposite side is substantially less than width S1.

Centered along third bottom edge 508, is a configuration of a seventh connection pad 528 is rectangular with one side coincident with third bottom edge 508. The width of the side of the rectangle of the seventh connection pad 528 that is coincident with third bottom edge 508 and that of its opposite side is substantially less than width S1. The length of the sides of the rectangle of the seventh connection pad 528 parallel to second bottom edge 506 is substantially less than length S2.

In a corner formed by third bottom edge 508 and fourth bottom edge 510, resides a configuration of an eighth connection pad 530. The eighth connection pad 530 is rectangular with one side coincident with third bottom edge 508 and an adjacent side coincident with fourth bottom edge 510. The width of the side of the rectangle of the eighth connection pad 530 that is coincident with third bottom edge 508 and that of its opposite side is substantially less than width S1. The length of the side of the rectangle of the eighth connection pad 530 that is coincident with fourth bottom edge 510 and that of its opposite side is substantially less than length S2. As will be appreciated by those skilled in the art, the various embodiments illustrated in FIGS. 5A-B may be modified in numerous aspects without departing from the scope and spirit of the disclosure.

Figure 6A:
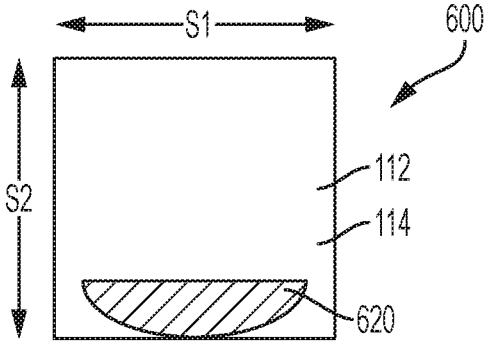
FIGS. 6A-D illustrate an embodiment of a UWB ceramic antenna with metallizations on the dielectric substrate according to the disclosure.
Figure 6B:
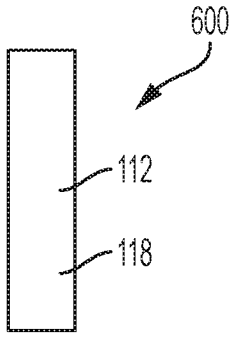
Figure 6C:
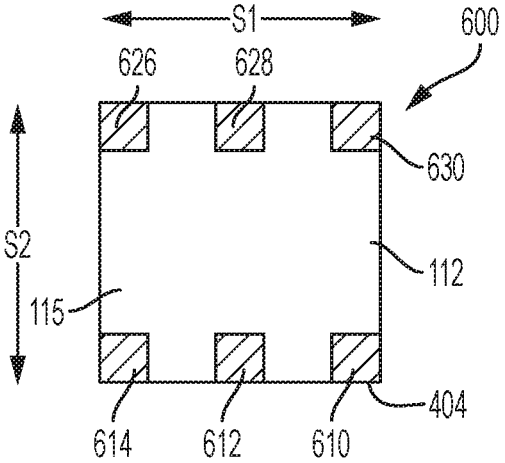
Figure 6D:
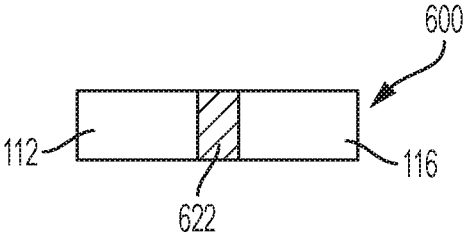

One specific embodiment of a suitable UWB ceramic antenna according to the disclosure is shown in FIGS. 6A-D. The antenna 600 is illustrated from a top view in FIG. 6A, where the radiator 620 is a semicircular radiator. The radiator 620 is illustrated as tangent to a first side. For this embodiment, second side surface 118 illustrated in FIG. 6B does not have any metalization connections. Turning to FIG. 6C, the bottom surface (opposite surface to FIG. 6A) is illustrated. A first connection pad 614 and is positioned at a first corner along the first side and a second connection pad 610 is positioned at a second corner along the first side. A bottom feed 612 is positioned between the first connection pad 614 and the second connection pad 610. The bottom feed 612 is separated from the first connection pad 614 by a first gap and from the second connection pad 610 by a second gap. On the edge opposite the first side, a series of three connection pads, third connection pad 626, fourth connection pad 628 and fifth connection pad 630. FIG. 6D illustrates the dielectric-ceramic substrate 112 from the side adjacent the first side. A side feed 622 is positioned midway along the width S1.

Figure 7C:
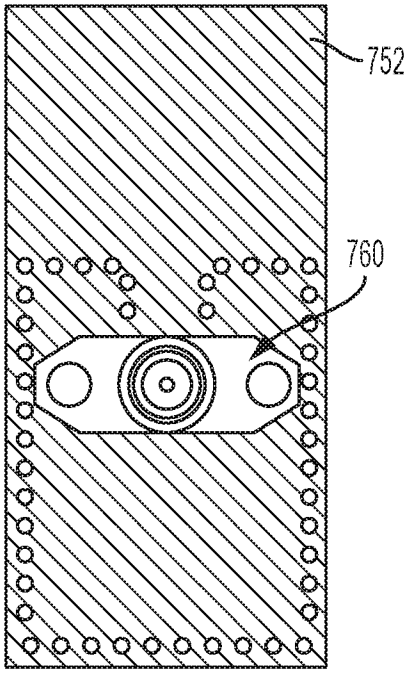
FIGS. 7A-C illustrate an embodiment of a UWB ceramic antenna positioned on an exemplar substrate board with ground plane and SMA connector according to the disclosure.
Figure 7B:
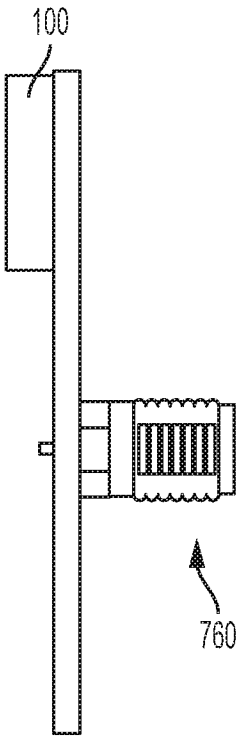
Figure 7A:
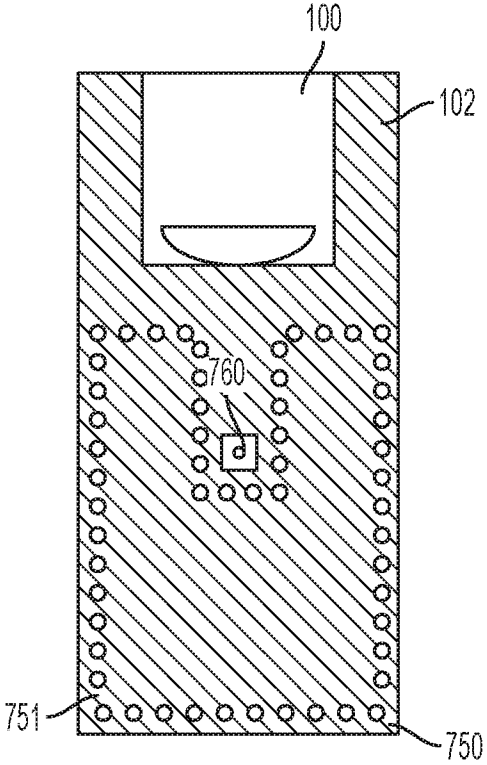

Turning to FIGS. 7A-C, an antenna 100 is illustrated positioned on a substrate, such as a PCB, in electrical communication with a connector 760, such as an SMA(F)ST connector. The connector 760 can be located in the center of the substrate as illustrated. The connector 760 passes through the substrate to the other side. As shown in FIG. 1A, feed line 106 lies on ground plane 102 and provides connection from the side feed area 122 to external electronics or devices via the connector 760. Lying on either side of feed line 106 on ground plane 102 separated by gaps are first metal element 751 and second metal element 752 which form a coplanar waveguide 104 as shown in FIG. 1A.

The antennas of this disclosure are passive devices that do not consume power. The antennas operate for short distances when transmitting large amount of digital data over a wide spectrum of frequency bands typically spanning more than 500 MHz. One such antenna covers all common UWB commercial bands, namely bands 1 through 10 simultaneously. The antenna typically has a peak gain of 4 dBi, an efficiency of more than 60% across the bands and is designed to be mounted directly onto a substrate such as a PCB. The antennas are typically mounted at least 3 mm from metal components or surfaces, and ideally 5 mm for optimal radiation efficiency. Placing two antennas of the disclosure at a far-field distance of from about 0.1 m to about 0.4 m, more preferably 0.3 m, and keeping one of the antennas stationary, while the other antenna is rotating in 45° intervals shows group delay variation smaller than 100 ps (as a benchmark) from 3 GHz to 5 GHz and from 6.4 GHz to 9 GHz spanning UWB channels 1-4 and 6-15. For channel 5 (6-7 GHz) the group delay variation is between 220 ps (at edge) and 50 ps, which is still acceptable. The length of ground plane can be taken into consideration when choosing a PCB size. Increase in the ground plane length in both lower band (3-5 GHz) and higher band (6-9 GHz) influences efficiency of the antenna.

Antennas according to the disclosure can be provided in kits which include one or more antennas, one or more PCBs, one or more connectors, and one or more cables.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An ultra-wideband antenna comprising:

a ceramic dielectric substrate having a substrate length, a substrate width and a substrate thickness, a first surface, a second surface, and a third surface, a fourth surface, a fifth surface, and a sixth surface, the ceramic dielectric substrate further comprising a first edge defined by an intersection of the first surface and the third surface;

a radiator positioned on at least a portion of the first surface of the ceramic dielectric substrate, wherein the radiator comprises a semi-circular radiator, the semi-circular radiator having a curved side facing the first edge of the ceramic dielectric substrate, the semi-circular radiator further comprising a chord line that is parallel with the first edge, the chord line having a length which is less than the substrate width, the chord line length also being less than a diameter dimension for the semi-circular radiator; and a feed positioned on the third surface of the ceramic dielectric substrate.

2. The ultra-wideband antenna of claim 1 wherein the ultra-wideband antenna operates within a range of frequencies from 3.1 GHz to 10 GHz.

3. The ultra-wideband antenna of claim 1 wherein the first surface of the ceramic dielectric substrate has a two-dimensional shape selected from square, rectangular, and parallelogram.

4. The ultra-wideband antenna of claim 1 wherein the first surface of the ceramic dielectric substrate is at least one of planar and substantially planar.

5. The ultra-wideband antenna of claim 1 wherein the feed is centered on the third surface of the ceramic dielectric substrate and occupies an entire substrate thickness and less than one-third of the substrate width or the substrate length.

6. The ultra-wideband antenna of claim 1 wherein the feed has a shape selected from circular, semi-circular, triangular, trapezoidal, square and rectangular.

7. The ultra-wideband antenna of claim 1 wherein the feed is centered on a bottom surface along a length and adjacent to an edge shared with one of the third surface, the fourth surface, the fifth surface, and the sixth surface.

8. The ultra-wideband antenna of claim 1 wherein the antenna is positioned on a substrate in electrical communication with a feed line.

9. The ultra-wideband antenna of claim 8 wherein feed line is in electrical communication with a connector.

10. The ultra-wideband antenna of claim 1 further comprising a first connection pad and a second connection pad positioned on the second surface of the ceramic dielectric substrate wherein the first connection pad is positioned adjacent a first side of the feed and the second connection pad is positioned adjacent a second side of the feed opposite the first connection pad.

11. The ultra-wideband antenna of claim 10 further comprising a third connection pad positioned on the second surface of the ceramic dielectric substrate.

12. An ultra-wideband antenna system comprising:

an ultra-wideband antenna comprising:

a ceramic dielectric substrate having a substrate length, a substrate width and a substrate thickness, a first surface, a second surface, a third surface, a fourth surface, a fifth surface, and a sixth surface, the ceramic dielectric substrate further comprising a first edge defined by an intersection of the first surface and the third surface;

a radiator positioned on at least a portion of the first surface of the ceramic dielectric substrate, wherein the radiator comprises a semi-circular radiator, the semi-circular radiator having a curved side facing the first edge of the ceramic dielectric substrate, the semi-circular radiator further comprising a chord line that is parallel with the first edge, the chord line having a length which is less than the substrate width, the chord line length also being less than a diameter dimension for the semi-circular radiator;

a feed positioned on the third surface of the ceramic dielectric substrate; and a ground plane having a feed line in electrical communication with the ultra-wideband antenna.

13. The ultra-wideband antenna system of claim 12 further comprising one or more ground plane fingers.

14. The ultra-wideband antenna system of claim 12 further comprising a coaxial RF connector.

15. The ultra-wideband antenna system of claim 12 wherein the feed line terminates on the ground plane within a perimeter of the feed of the antenna.

16. The ultra-wideband antenna system of claim 12 further comprising two metallic elements positioned either side of the feed line on the ground plane separated by gaps which form a coplanar waveguide.

17. The ultra-wideband antenna system of claim 12 wherein the antenna transmits a large amount of digital data over a wide spectrum of frequency bands spanning more than 500 MHz at a low power for short distances.

18. The ultra-wideband antenna system of claim 12 wherein the antenna covers UWB band 1 through UWB band 10 simultaneously.

19. The ultra-wideband antenna system of claim 12 wherein the ultra-wideband antenna further comprises a first connection pad and a second connection pad positioned on the second surface of the ceramic dielectric substrate wherein the first connection pad is positioned adjacent a first side of the feed and the second connection pad is positioned adjacent a second side of the feed opposite the first connection pad.

20. The ultra-wideband antenna system of claim 19 wherein the ultra-wideband antenna further comprises a third connection pad positioned on the second surface of the ceramic dielectric substrate.

21. An ultra-wideband antenna method comprising the steps of:

providing an ultra-wideband antenna comprising a ceramic dielectric substrate having a substrate length, a substrate width and a substrate thickness, a first surface, a second surface, a third surface, a fourth surface, a fifth surface, and a sixth surface, the ceramic dielectric substrate further comprising a first edge defined by an intersection of the first surface and the third surface, a semi-circular radiator positioned on at least a portion of the first surface of the ceramic dielectric substrate, the semi-circular radiator having a curved side facing the first edge of the ceramic dielectric substrate, the semi-circular radiator further comprising a chord line that is parallel with the first edge, the chord line having a length which is less than the substrate width, the chord line length also being less than a diameter dimension for the semi-circular radiator and a feed positioned on the third surface of the ceramic dielectric substrate; and operating the ultra-wideband antenna at radio-frequency communications from 3.1 GHz to 10 GHz.

22. The method of claim 21 further comprising operating the ultrawideband antenna at a peak gain of 4 dBi.

23. The method of claim 21 further comprising operating the ultra-wideband antenna at an efficiency of more than 60% across UWB band 1 through UWB band 10.

24. The method of claim 23 wherein the operating of the ultrawideband antenna at an efficiency of more than 60% across UWB band 1 through UWB band 10 occurs simultaneously.

25. The method of claim 23 wherein the ultra-wide antenna further comprises a first connection pad and a second connection pad positioned on the second surface of the ceramic dielectric substrate wherein the first connection pad is positioned adjacent a first side of the feed and the second connection pad is positioned adjacent a second side of the feed opposite the first connection pad.

26. The method of claim 25 wherein the ultra-wide antenna further comprises a third connection pad positioned on the second surface of the ceramic dielectric substrate.

27. An ultra-wideband antenna kit comprising:

one or more ultra-wideband antennas comprising a ceramic dielectric substrate having a substrate length, a substrate width and a substrate thickness, a first surface, a second surface, a third surface, a fourth surface, a fifth surface, and a sixth surface, the ceramic dielectric substrate further comprising a first edge defined by an intersection of the first surface and the third surface, a semi-circular radiator positioned on at least a portion of the first surface of the ceramic dielectric substrate, the semi-circular radiator having a curved side facing the first edge of the ceramic dielectric substrate, the semi-circular radiator further comprising a chord line that is parallel with the first edge, the chord line having a length which is less than the substrate width, the chord line length also being less than a diameter dimension for the semi-circular radiator, and a feed positioned on the third surface of the ceramic dielectric substrate; and one or more of each of a ground plane, a PCB, a connector, and a cable.

28. The kit of claim 27 wherein the one or more ultra-wideband antennas further comprises a first connection pad and a second connection pad positioned on the second surface of the ceramic dielectric substrate wherein the first connection pad is positioned adjacent a first side of the feed and the second connection pad is positioned adjacent a second side of the feed opposite the first connection pad.

29. The kit of claim 28 wherein the one or more ultra-wideband antennas further comprises a third connection pad positioned on the second surface of the ceramic dielectric substrate.

* * * * *